US009876303B2

(12) United States Patent
Suemitsu

(10) Patent No.: US 9,876,303 B2
(45) Date of Patent: Jan. 23, 2018

(54) ELECTRICAL CONNECTOR WITH PRESS FITTING CONTACTS

(71) Applicant: Tyco Electronics Japan G.K., Kanagawa (JP)

(72) Inventor: Yoshifumi Suemitsu, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/790,674

(22) Filed: Jul. 2, 2015

(65) Prior Publication Data

US 2016/0006194 A1 Jan. 7, 2016

(30) Foreign Application Priority Data

Jul. 4, 2014 (JP) ..... 2014-138508

(51) Int. Cl.

| | |
|---|---|
| ***H01R 24/00*** | (2011.01) |
| ***H01R 13/41*** | (2006.01) |
| *H01R 107/00* | (2006.01) |
| *H01R 13/533* | (2006.01) |

(52) U.S. Cl.

CPC ..... *H01R 13/41* (2013.01); *H01R 13/533* (2013.01); *H01R 2107/00* (2013.01)

(58) Field of Classification Search

CPC ..... H01R 13/41

USPC ..... 439/660, 751, 733.1

See application file for complete search history.

(56) References Cited

U.S. PATENT DOCUMENTS

| | | | | | |
|---|---|---|---|---|---|
| 3,530,422 | A * | 9/1970 | Goodman | H01R 12/585 | 29/845 |
| 4,464,007 | A * | 8/1984 | Parmer | H01R 12/585 | 439/389 |
| 4,698,026 | A * | 10/1987 | Rolf | H01R 12/58 | 439/751 |
| 5,035,656 | A * | 7/1991 | Patel | H01R 12/58 | 439/733.1 |
| 5,152,700 | A * | 10/1992 | Bogursky | H01R 13/428 | 439/733.1 |
| 5,326,286 | A * | 7/1994 | Bixler | H01R 12/675 | 439/405 |
| 5,980,271 | A * | 11/1999 | MacDougall | H01R 13/41 | 439/733.1 |
| 6,068,494 | A | 5/2000 | Tokuwa | | |
| 6,305,949 | B1 | 10/2001 | Okuyama et al. | | |

(Continued)

FOREIGN PATENT DOCUMENTS

| | | |
|---|---|---|
| JP | 5091081 U | 8/1975 |
| JP | 718369 U | 3/1995 |

(Continued)

OTHER PUBLICATIONS

Abstract of JP 2001273944, dated Oct. 5, 2001, 1 page.

(Continued)

*Primary Examiner* — Tulsidas C Patel
*Assistant Examiner* — Peter G Leigh
(74) *Attorney, Agent, or Firm* — Barley Snyder

(57) ABSTRACT

An electrical connector is provided and includes a housing and a contact. The housing includes a retention wall with a contact receiving passageway. The contact is secured in the contact receiving passageway and includes a front press fitting section and a rear press fitting section positioned rearward of the front press fitting section by a pitch.

15 Claims, 7 Drawing Sheets

(56) References Cited

U.S. PATENT DOCUMENTS 6,328,576 B1 * 12/2001 Takahashi ..... H01R 13/41 439/733.1
6,685,486 B1 * 2/2004 Zhang ..... H01R 13/6215 439/79
6,971,928 B2 * 12/2005 Shindo ..... H01R 13/05 439/857
7,083,478 B1 * 8/2006 Kutsuna ..... H01R 13/41 439/733.1
7,125,285 B2 * 10/2006 Maejima ..... H01R 12/523 439/82
7,175,480 B2 * 2/2007 Yamashita ..... H01R 13/41 439/733.1
7,179,123 B2 * 2/2007 Ohara ..... H01R 13/41 439/595
7,448,918 B2 * 11/2008 Lappoehn ..... H01R 13/41 439/660
7,458,148 B2 * 12/2008 Matsumura ..... H01R 43/20 29/837
7,591,655 B2 * 9/2009 Fedder ..... H01R 12/585 439/108
7,722,413 B2 * 5/2010 Tonosaki ..... H01R 13/41 439/733.1
7,789,716 B2 * 9/2010 Fedder ..... H01R 12/585 439/607.07
8,142,236 B2 * 3/2012 Fedder ..... H01R 12/585 439/751
8,210,856 B2 * 7/2012 Suzuki ..... H01R 12/585 439/733.1
8,616,901 B2 12/2013 Shindo
8,702,454 B2 * 4/2014 Hamada ..... H01R 13/04 439/733.1
8,727,815 B1 * 5/2014 Mongold ..... H01R 43/205 439/751
9,142,905 B2 * 9/2015 Yu ..... H01R 13/4367
9,214,760 B2 * 12/2015 Endo ..... H01R 13/58
9,219,325 B2 * 12/2015 Endo ..... H01R 12/73
2004/0242082 A1 * 12/2004 Tsuchiya ..... H01R 12/585 439/751
2005/0250356 A1 * 11/2005 Matsumura ..... H01R 12/585 439/82
2005/0277341 A1 * 12/2005 Noguchi ..... H01R 13/41 439/884
2006/0035534 A1 * 2/2006 Sakamaki ..... H01R 13/05 439/733.1
2009/0156044 A1 * 6/2009 Mito ..... H01R 13/41 439/343
2010/0136852 A1 * 6/2010 Mito ..... H01R 13/41 439/733.1
2013/0267122 A1 * 10/2013 Hamada ..... H01R 13/41 439/626
2014/0017914 A1 * 1/2014 Endo ..... H01R 12/7082 439/81

FOREIGN PATENT DOCUMENTS

JP 2001273944 A 10/2001
JP 200556805 A 3/2005
JP 2005123048 A 5/2005
JP 2005135794 A * 5/2005
JP 200871678 A 3/2008
JP 2008243745 A 10/2008
JP 2011119129 A 6/2011
JP 2013168324 A 8/2013
JP 2013235772 A 11/2013

OTHER PUBLICATIONS

Abstract of JP 2005-123048, dated May 12, 2005, 1 page.
Abstract of JP 2008-243745, dated Oct. 9, 2008 1 page.
Abstract of JP 2011-119129, dated Jun. 16, 2011, 1 pages.
Abstract of JP2013235775, dated Nov. 21, 2013, 1 page.
Abstract of JP2013168324, dated Aug. 29, 2013, 2 pages.
Japanese Office Action, dated Dec. 5, 2017, 5 pages.

* cited by examiner

ELECTRICAL CONNECTOR WITH PRESS FITTING CONTACTS

CROSS-REFERENCE TO RELATED APPLICATION

This application claims the benefit of the filing date under 35 U.S.C. § 119(a)-(d) to Japanese Patent Application No. JP 2014-138508 filed on Jul. 4, 2014.

FIELD OF THE INVENTION

The present invention relates to an electrical connector and, more particularly, to an electrical connector having contact press fit in a contact receiving passageway.

BACKGROUND

An electrical connector (simply referred to as connector below) serving as a device provided between electrical devices to transmit a control signal or electrical power is used for various purposes. In particular, a connector mounted in an automobile, for example, needs to have a vibration-resisting property since the electrical connector is subjected to continuous vibrations as the automobile runs.

Known connectors are generally equipped with, as main components, a terminal contact directly transmitting a control signal or the like, and a housing holding the contact. As for the vibration resisting property, the housing and the contact need to individually have a predetermined vibration-resisting property.

Press fitting is generally used to secure the contact in the housing. If the contact is not properly fitted in the housing, then vibrations may occur that reduce the electrical connector's proficiency. Therefore, a press fitting method for the contact with respect to the housing is important for a vibration-resisting property.

Regarding the press fitting of the contact to the housing, various suggestions have been made.

For example, Japanese Paten Application JP2012-146454A generally discloses a connector in which two press fitting sections 20 are provided in a contact 10 with a space provide there between along an axial direction of the contact. A distal end side of the contact is press fit in the housing is prevented upward movement.

Further, Japanese Paten Application JP2012-142152A generally discloses a connector in which an engaging shaft section 51 meshing with a contact press fitting section 42 of a housing 21 is provided in a contact to prevent the contact from coming out of the housing. In addition, a restricted section inserted into a Z-directional restricting section 41 of the housing is provided to locate an insertion depth of the contact 25.

As described above, suggestions regarding press fitting of a contact have been made, but these have not fully taken a vibration-resisting property into consideration. In particular, including the prior art, known techniques have a difficulty in satisfying a vibration-resisting property corresponding to a severe vibration conditions, such as being used in a region near a source of vibration.

SUMMARY

The invention has been made in view of such a problem, among others, and an object thereof is to provide a connector capable of withstanding severe vibration conditions.

An electrical connector according to the invention is provided and includes a housing and a contact. The housing includes a retention wall with a contact receiving passageway. The contact is secured in the contact receiving passageway and includes a front press fitting section and a rear press fitting section positioned rearward of the front press fitting section by a pitch.

BRIEF DESCRIPTION OF THE DRAWINGS

The invention will now be described by way of example, with reference to the accompanying Figures, of which:

FIG. 7 is a partial sectional view of the electrical connector of FIG. 1A showing a contact press fit into a housing there of.

DETAILED DESCRIPTION OF THE EMBODIMENTS

Hereinafter, based on an embodiment illustrated in the accompanying drawings, the present invention will be described in detail.

Figure 1A:
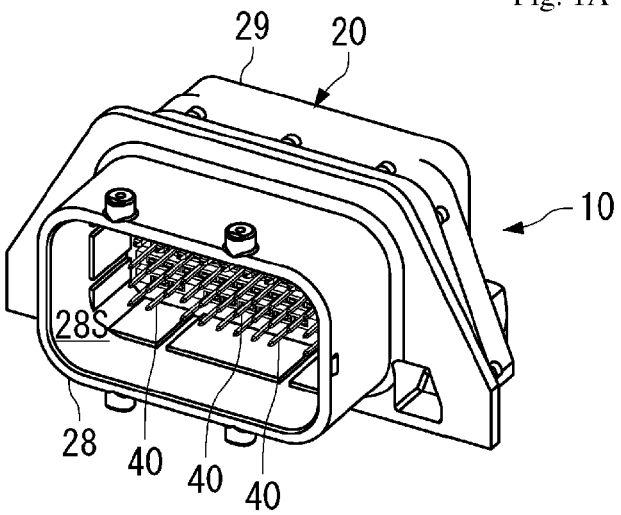
FIG. 1A is a front perspective view of an electrical connector according to the invention.
Figure 1B:
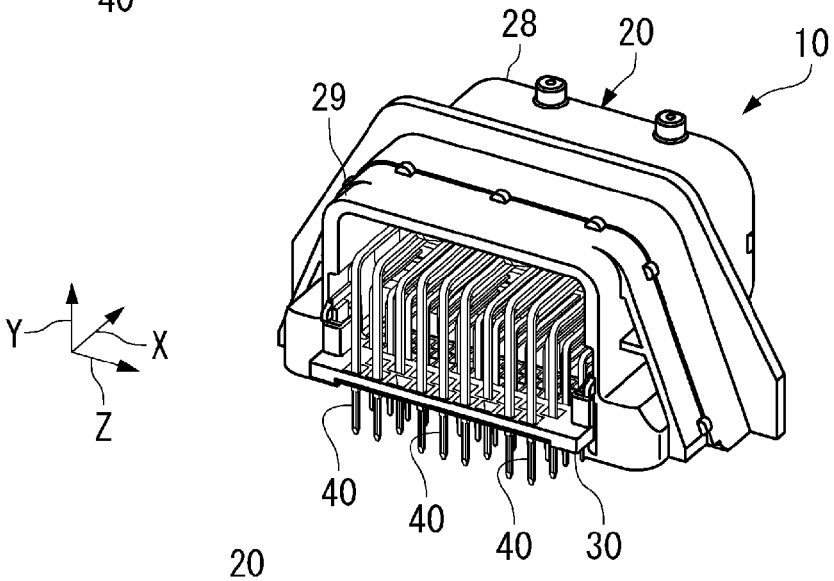
FIG. 1B is a rear perspective view of the electrical connector of FIG. 1A.
Figure 1C:
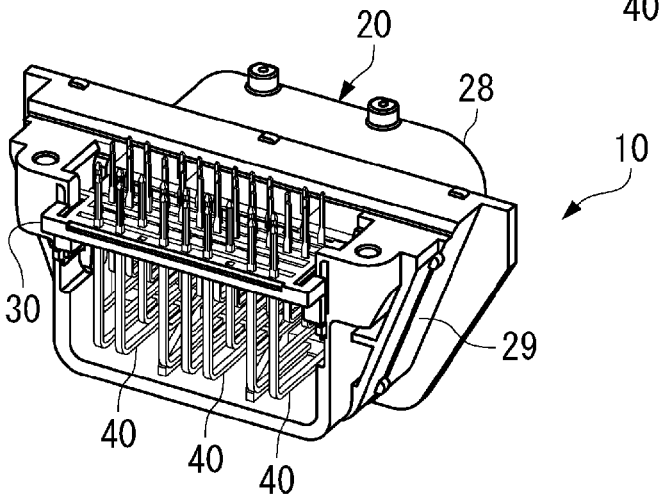
FIG. 1C is a bottom perspective view of the electrical connector of FIG. 1A.

With reference to FIGS. 1A, 1B, and 1C, an electrical connector 10 according to an embodiment of the invention is to be mounted on a circuit board (not shown). In the shown embodiment shown, the electrical connector 10 includes a housing 20 and a plurality of contacts 40 press fit in the housing 20. The electrical connector 10 has an improved vibration-resisting property, and in particular has a structure capable of preventing the contacts 40 from movement and damage by vibrations.

It should be noted that, a side of the electrical connector 10 that is mutually mated with a mating connector (not shown) is defined as a front side, and the opposite side as a rear side, and a lower side on which the circuit board is disposed is defined as an underside, and the opposite side as an upper side.

With reference to FIG. 1A through FIG. 2B, a housing 20 includes a retention wall 21 holding the plurality of contacts 40. The housing 20 also includes a mating hood 28 (i.e. cylindrical shaped in the shown embodiment) along a front of the retention wall 21 for mating with a mating connector, and a cover 29 positioned behind the retention wall 21 for covering the contacts 40 extending rearward from the retention wall 21. The retention wall 21, the mating hood 28, and the cover 29 are integrally formed by injection molding of insulating resin.

Contact receiving passageways 23 are positioned along and penetrate through the retention wall 21. The contact receiving passageways 23 are vertically and horizontally aligned by as many as the contacts 40 to be held in the housing 20. In the shown embodiment, the contact receiving passageways 23 are provided as five levels in a height direction Y.

A press fitting support 22 is provided on the retention wall 21 and positioned to correspond to each contact receiving passageway 23. The press fitting support 22 includes a ridge extending in along a width of the retention wall 21, and the contact receiving passageway 23 extends through the retention wall 21 including the press fitting support 22. In the shown embodiment, the press fitting support 22 (denoted by 22A and corresponding to the contact receiving passageway 23A) are provided along an uppermost level and extend further rearward than the press fitting supports 22 provided there below. This causes the contact 40 press fit in the contact receiving passageway 23A located at the uppermost level to have a longer held length than the other contacts 40 and accordingly a shorter exposed length, and an advantageous effect resulting from this will be described later.

The mating hood 28 includes a receiving space 28S formed inside, and this receiving space 28S receives a mating portion of a mating connector so that the electrical connector 10 and the mating connector are mutually mated with each other. The contacts 40 held by the retention wall 21 are covered with the mating hood 28, and are electrically connected with contacts of the mating connector within the receiving space 28S.

In the shown embodiment, the cover 29 includes three sides: an upper side, a left side, and a right side. The contacts 40 penetrating the retention wall 21 are disposed in the cover 29 so that the cover 29 protects the contacts 40 from external elements. The cover 29 holds a tine plate 30 in the lower end thereof. The tine plate 30 allows the contacts 40 corresponding to a plurality of locating holes 31 penetrating the tine plate 30, respectively, to extend there through, thereby locating the contacts 40. The tine plate 30 is produced separately from the housing 20, and attached to an appropriate region.

Figure 2A:
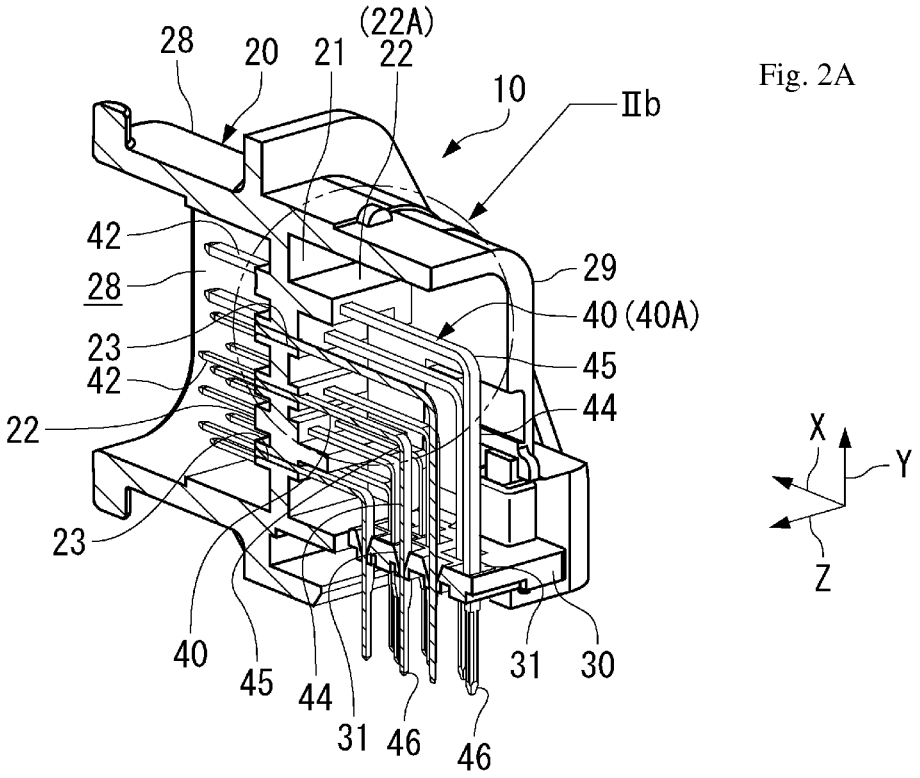
FIG. 2A is a sectional perspective view of the electrical connector of FIG. 1A.
Figure 2B:
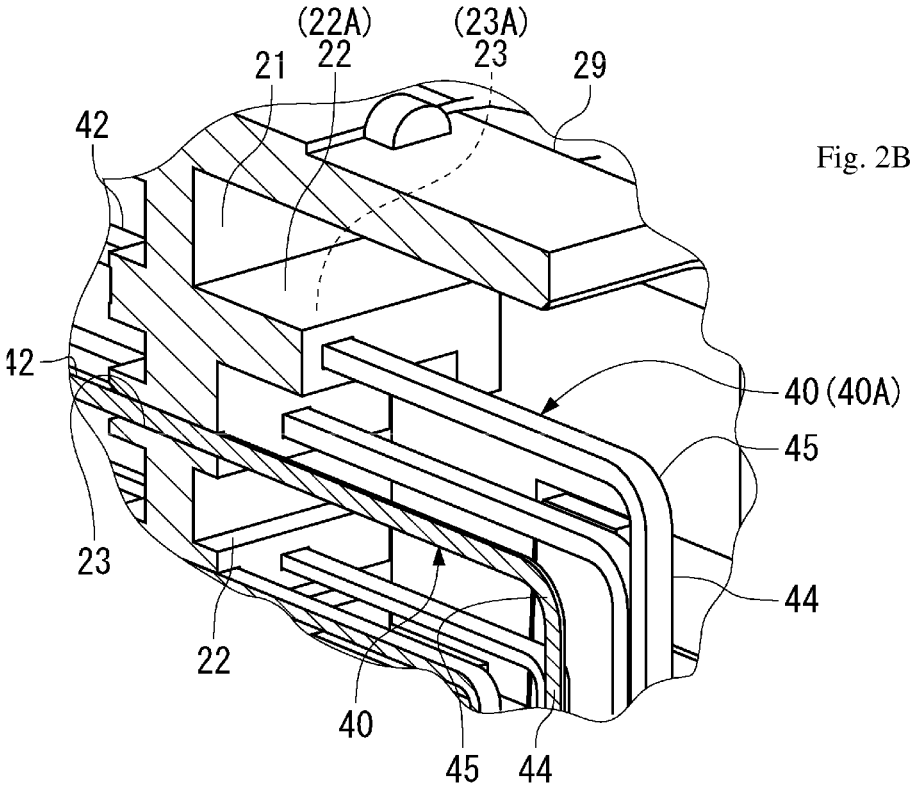
FIG. 2B is a partial enlarged view of the electrical connector of FIG. 2A showing region IIB.

As shown in FIGS. 2A and 2B, the contact 40 includes has a horizontal section 42 having a region to be connected to a contact of the mating connector, a vertical section 44 to be inserted into a connection hole of the circuit board and having at the distal end a tine 46 to be electrically connected to the circuit board, and a bent section 45 provided along a boundary section between the horizontal section 42 and the vertical section 44. It should be noted that, in the shown embodiment, the contact 40 is manufactured from a straight contact 40, thereby obtaining an L shape having the bent section 45.

The contact 40 is held in the housing 20 such that the horizontal section 42 extends along the mating direction X and the vertical section 44 extends along the height direction Y perpendicular to the mating direction X. The contact 40 is manufactured from a highly-conducting material, such as a copper alloy. It should be noted that the thickness (a dimension in the height direction Y) of the contact 40 is constant.

The tines 46 of the plurality of contacts 40 are arranged in parallel with one another, and the tines 46 of all the contacts 40 are arranged so as to correspond to the connection holes of the circuit board. The tines 46 are to be fixed to the circuit board by soldering at the connection holes.

As shown in FIGS. 1A through 2B, the plurality of contacts 40 are arranged along a width of the housing 20, and the plurality of contacts 40 are also arranged along the height of the housing 20. Among these, the contact 40A held at the contact receiving passageway 23A and positioned at the uppermost level of the housing 20 has a farthest distance from the horizontal section 42 to the circuit board than the contacts 40 held in the contact receiving passageways 23 below the contact 40A. Therefore, the contact 40A has the longest exposed length among the contacts 40, and is accordingly most likely to resonate on receiving vibration. Thus, In the shown embodiment, in order to prevent resonance from occurring, a characteristic structure is adopted for a press fitting section of the contact 40A and the contact receiving passageway 23A corresponding to this press fitting section. A structure of the press fitting section of the contact 40A and a structure of the contact receiving passageway 23A are described below sequentially.

Figure 3A:
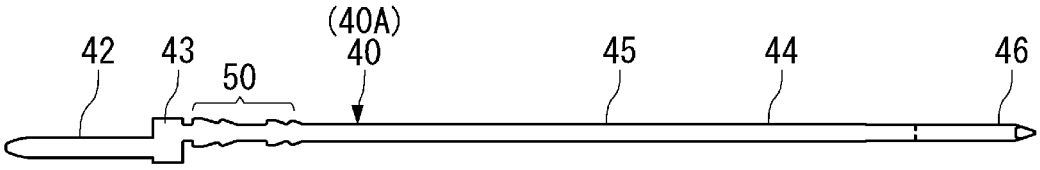
FIG. 3A is top plan view of a contact of the electrical connector of FIG. 1A.
Figure 3B:
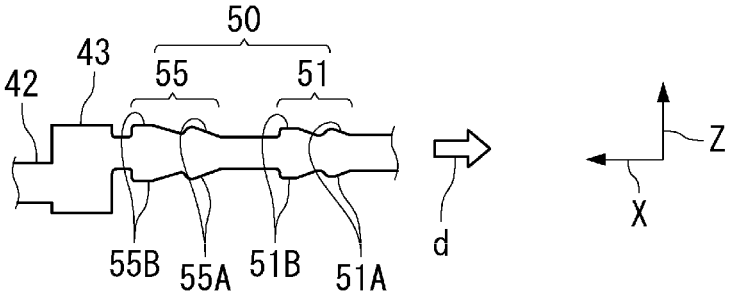
FIG. 3B is a partial enlarged view of the contact of FIG. 3A.
Figure 3C:
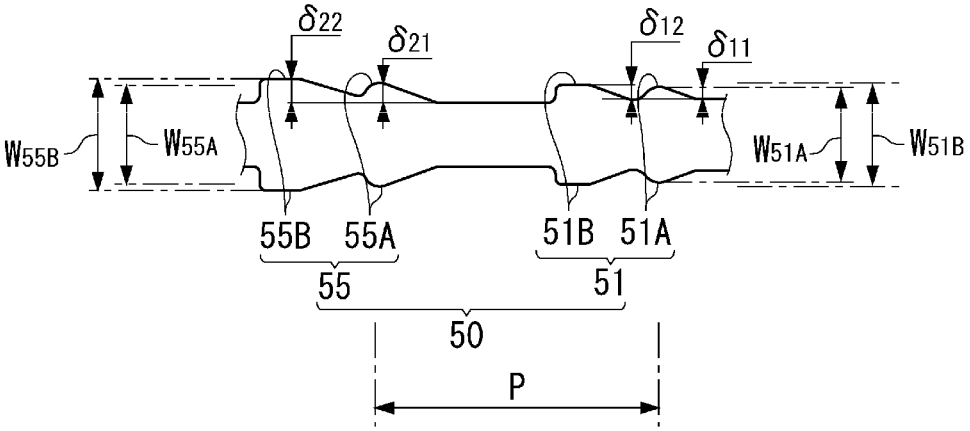
FIG. 3C is a partial enlarged view of the contact of FIG. 3B.

As shown in FIGS. 3A through 3C, the contact 40A has a horizontal section 42 provided with a press fitting section 50. It should be noted that FIG. 3A shows a contact 40A before providing the bent section 45.

The press fitting section 50 includes a front press fitting section 51 and a rear press fitting section 55 positioned behind the front press fitting section 51 when the contact 40A is positioned into the contact receiving passageway 23A.

The front press fitting section 51 includes a pair of first front press fitting protrusions 51A and a pair of second front press fitting protrusions 51B.

The pair of first front press fitting protrusions 51A and the pair of second front press fitting protrusions 51B are formed so as to protrude by a predetermined amount from both sides along a width thereof, respectively. When the contact 40A is inserted into the contact receiving passageway 23A, the first front press fitting protrusions 51A are inserted into the contact receiving passageway 23A ahead of the second front press fitting protrusions 51B.

The rear press fitting section 55 includes a pair of first rear press fitting protrusions 55A and a pair of second rear press fitting protrusions 55B.

The pair of first rear press fitting protrusions 55A and the pair of second press fitting protrusions 55B are formed so as to protrude by a predetermined amount from both sides along a width thereof, respectively. When the contact 40A is inserted into the contact receiving passageway 23A, the first rear press fitting protrusions 55A are inserted into the contact receiving passageway 23A ahead of the second rear press fitting protrusions 55B.

With respect to the front press fitting section 51, the second press fitting protrusions 51B has a width by a larger than a width of the first front press fitting protrusions 51A.

As shown in FIG. 3C, δ11 is a protrusion amount of the first front press fitting protrusion 51A and δ12 is a protrusion amount of the second front press fitting protrusion 51B. In the shown embodiment, the δ12 is larger than the δ11. That is, in the front press fitting section 51, the protrusion amount of the press fitting protrusion inserted ahead into the contact receiving passageway 23A is small. In this regard, a width W51A of the contact 40A in the first front press fitting protrusions 51A is smaller than a width W51B of the contact 40A in the second front press fitting protrusions 51B.

Next, in the rear press fitting section 55, the second press fitting protrusions 55B protrude by a larger amount than the first rear press fitting protrusions 55A, and δ22>δ21 is satisfied, where δ21 is a protrusion amount of the first rear press fitting protrusion 55A and δ22 is a protrusion amount of the second rear press fitting protrusion 55B. That is, also in the rear press fitting section 55, the protrusion amount of the press fitting protrusion inserted ahead into the contact receiving passageway 23A is small. In this regard, a width W55A of the contact 40A in the first rear press fitting protrusions 55A is less than a width W55B of the contact 40A in the second rear press fitting protrusions 55B is denoted by W55B.

It should be noted that, when the protrusion amounts of the first and second press fitting protrusions 51A, 51B, 55A, 55B of the front press fitting section 51 and the rear press fitting section 55 are compared with each other, the following condition is satisfied. That is, the rear press fitting section 55 is set so as to have a larger protrusion amount than the front press fitting section 51. Accordingly, δ22>δ21>δ12>δ11.

The contact 40A is set such that a pitch P in the mating direction X between the first press fitting protrusion 51A of the front press fitting section 51 and the first rear press fitting protrusion 55A of the rear press fitting section 55 corresponds to a depth D of a second contact receiving section 25 of the contact receiving passageway 23A described later in a mating direction. The reason to do so will be given when the process of press-fitting the contact 40A into the contact receiving passageway 23A is explained.

Figure 4B:
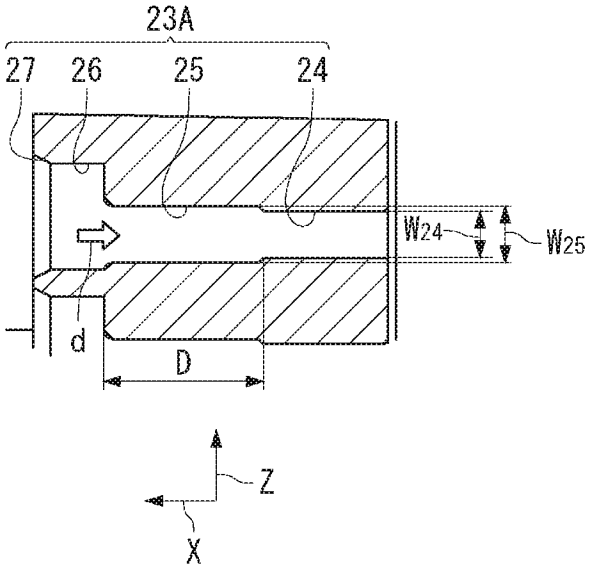
FIG. 4B is a partial enlarged view of the electrical connector of FIG. 4A showing region IVB.
Figure 4A:
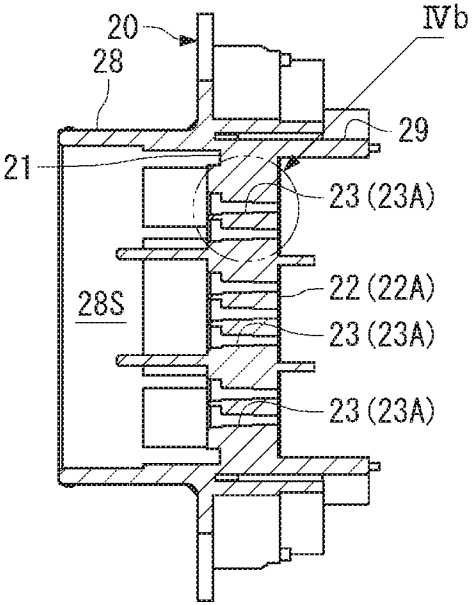
FIG. 4A is a sectional view of the electrical connector of FIG. 1A showing uppermost contact receiving passageways.
Figure 4C:
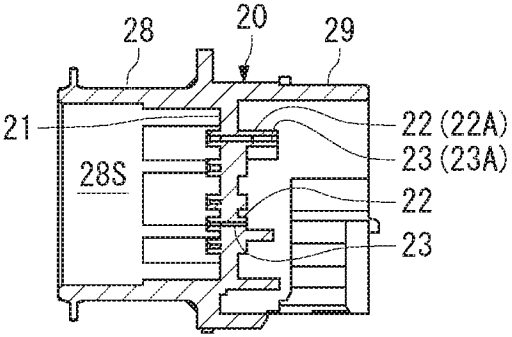
FIG. 4C is another sectional view of the electrical connector of FIG. 1A.

Next, the contact receiving passageway 23A will be described with reference to FIGS. 4*a* through 4C.

The contact receiving passageway 23A is formed so as to extend through the retention wall 21, including the press fitting support 22A. The contact receiving passageway 23A includes a first contact receiving section 24, a second contact receiving section 25, a restriction section 26, and a contact receiving through-hole 27 in this order from the rear side. The first contact receiving section 24 is fitted with the front press fitting section 51, thereby holding the contact 40A, and the second contact receiving section 25 is fitted with the rear press fitting section 55, thereby holding the contact 40A.

The first contact receiving section 24 has a width W24 than a width W25 of the second contact receiving section 25. It should be noted that, except the contact receiving through-hole 27, a dimension in the height direction Y of the contact receiving passageway 23A is constant. Further, a direction of force occurring when the front press fitting section 51 and the rear press fitting section 55 are press fit into the retention wall 21 (defined as a press fitting direction) corresponds to the width direction Z.

The first contact receiving section 24 is a region in which the front press fitting section 51 is press fit, and the width W24 in the first contact receiving section 24, the width W51A in the first front press fitting protrusion 51A and the width W51B in the second front press fitting protrusion 51B satisfy W24<W51A<W51B.

The second contact receiving section 25 is a region in which the rear press fitting section 55 is press fit, and the width W25 in the second contact receiving section 25, the width W55A in the first press fitting protrusion 55A and the width W55B in the second press fitting protrusion 55B satisfy W25<W55A<W55B.

In this regard, δ2<δ1 is satisfied, where a difference between the width W24 and the width W51A is defined as a press fitting allowance δ1 in the front press fitting section 51, and a difference between the width W25 and the width W55A is defined as a press fitting allowance δ2 in the rear press fitting section 55.

The second contact receiving section 25 is formed such that the depth D in an insertion direction d of the contact 40A corresponds to the pitch P between the front press fitting section 51 and the rear press fitting section 55 in the contact 40A described above.

As shown, the restriction section 26 is to be wider than the second contact receiving section 25, and receives a stop section 43 provided at a root of the horizontal section 42 of the contact 40A press fit. An insertion depth of the contact 40A when being inserted into the contact receiving passageway 23A is restricted by causing a step forming a boundary between the restriction section 26 and the second contact receiving section 25 to catch a rear end face of the stop section 43.

The contact receiving through-hole 27 is provided so as to insert the stop section 43 into the restriction section 26 easily and has such a tapered shape that an opening is reduced from a front thereof toward a rear thereof.

Though the contact 40A and the contact receiving passageway 23A into which the contact 40A is press fit have been described above, only one press fitting section is formed in the contact 40 except the contact 40A, and the contact receiving passageways 23 except the contact receiving passageway 23A are formed so as to be constant in dimension in the width directions thereof.

Next, with reference to FIGS. 5A through 6D, a procedure for press fitting the contact 40A into the housing 20 through the contact receiving passageway 23A will be described.

Figure 5A:
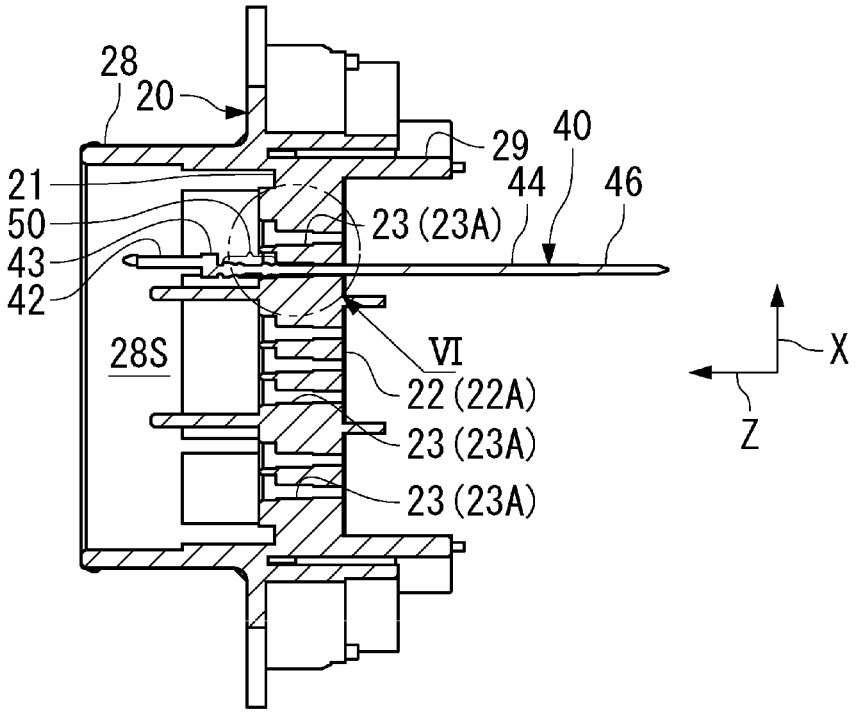
FIG. 5A is a sectional view of the electrical connector of FIG. 1A showing insertion of a contact into a housing.
Figure 6A:
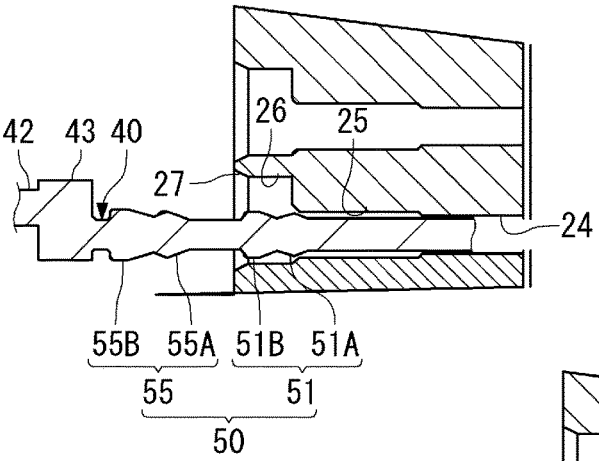
FIG. 6A is an partial enlarged sectional view of the electrical connector of FIG. 5B showing insertion of the contact into the housing within region VI.

The contact 40A is inserted into the contact receiving passageway 23A through the contact receiving through-hole 27 (see FIG. 5A, FIG. 6A).

Figure 6B:
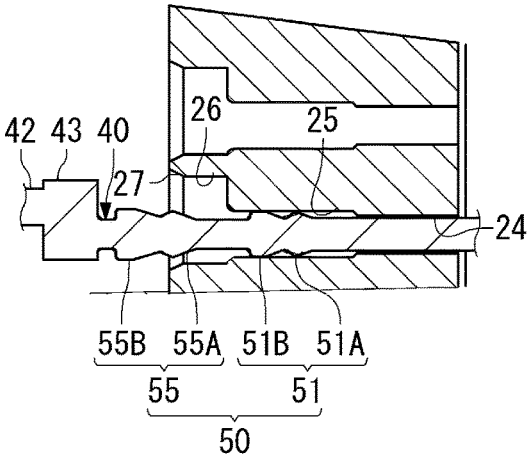
FIG. 6B is another partial enlarged sectional view of the electrical connector of FIG. 5B showing further insertion of the contact into the housing within region VI.
Figure 6C:
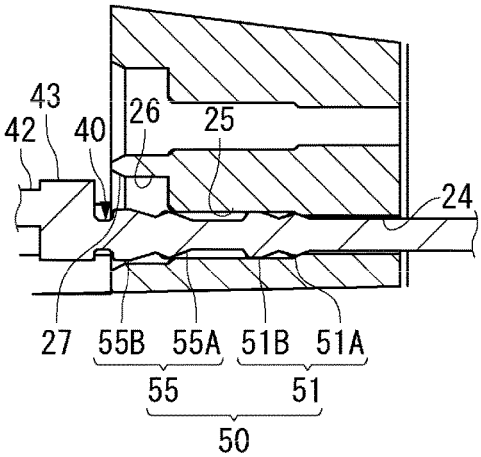
FIG. 6C is another partial enlarged sectional view of the electrical connector of FIG. 5B showing yet further insertion of the contact into the housing within region VI.
Figure 6C:
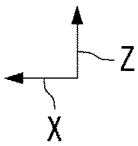

As the contact 40A is pushed in, the front press fitting section 51 advances in the second contact receiving section 25 (see FIG. 6B). Since the widths W51A, W51B of the front press fitting section 51 are narrower than the width W25 of the second contact receiving section 25, the front press fitting section 51 is not subjected to a large load. Therefore, the contact 40A can easily be pushed in, and the front press fitting section 51 never scrapes and damages the housing 20 around the second contact receiving section 25.

The contact 40A is pushed in until the first front press fitting protrusions 51A reach the step in the boundary section between the second contact receiving section 25 and the first contact receiving sections 24. Then, since the pitch P between the front press fitting section 51 and the rear press fitting section 55 is equal to the depth D of the second contact receiving section 25, the first rear press fitting protrusions 55A of the rear press fitting section 55 reach a front side of the second contact receiving section 25 (see FIG. 6C). In this manner, the timing of when the first front press fitting protrusions 51A reach the first contact receiving section 24 and the timing of when the first rear press fitting protrusions 55A reaches the second contact receiving section 25 can be caused to coincide with each other.

When the contact 40A is further pushed in, the front press fitting section 51 advances in the first contact receiving section 24 while being press fit, and the rear press fitting section 55 also advances in the second contact receiving section 25 while being press fit. In this regard, as described above, since the press fitting allowance δ2 of the rear press fitting section 55 with respect to the second contact receiving section 25 is smaller than the press fitting allowance δ1 of the front press fitting section 51 with respect to the first contact receiving section 24, the rear press fitting section 55 receives a lower resistance than the front press fitting section 51 when the contact 40A is pushed in. Therefore, a force required to push in the contact 40A can be made small, as compared with the case where the press fitting allowance δ2 is equal to the press fitting allowance δ1.

Further, in the first contact receiving section 24 and the second contact receiving section 25, the contact 40A has the front press fitting section 51 and the rear press fitting section 55 brought in contact with and supported on the housing 20 at two locations in the mating direction X. In this regard, if only the front press fitting section 51 having the large press fitting allowance δ1 advances its press fitting while being supported at a single location in the mating direction X, an axial force occurring in a section preceding the front press fitting section 51 may increase, causing a buckling in the contact 40A. In contrast, when supporting at the two locations of the front press fitting section 51 and the rear press fitting section 55, is performed, like the embodiment, the axial force at such a section can be reduced, so that a buckling can be prevented from occurring in the section preceding the front press fitting section 51.

Figure 5B:
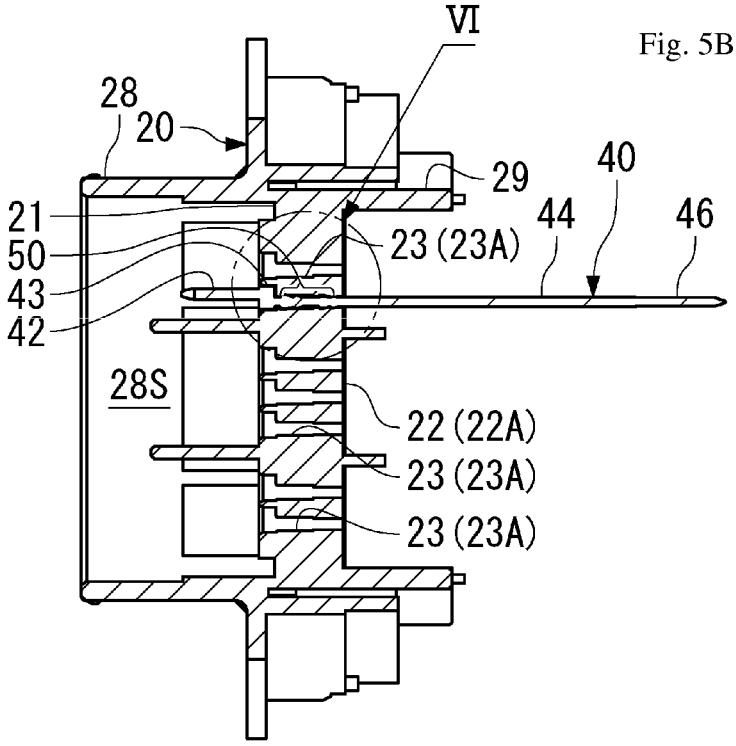
FIG. 5B is a sectional view of the electrical connector of FIG. 1A showing the contact press fit into the housing.
Figure 6D:
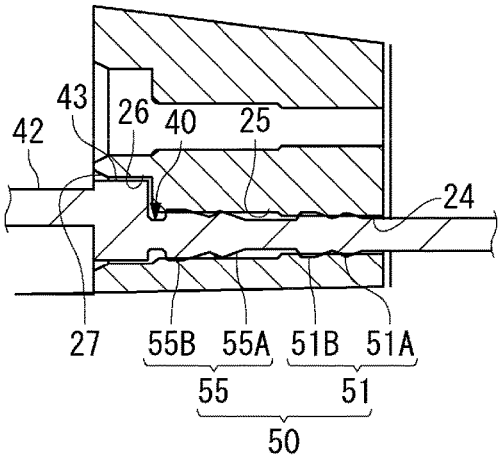
FIG. 6D is another partial enlarged sectional view of the electrical connector of FIG. 5B showing the contact press fit into the housing within region VI.

When the contact 40A is further pushed in, and the rear end face of the stop section 43 is caught by the step forming the boundary between the restriction section 26 and the second contact receiving section 25, the sequence of press fitting steps is completed (see FIG. 6A, FIG. 6D). It should be noted that FIG. 5B illustrates the front press fitting section 51 and the rear press fitting section 55 interfering with the housing 20, and this interference corresponds to the press fitting allowance.

As for press fitting of the contact 40A, a press fitting device (not shown) can be used to insert the contact 40A automatically into each contact receiving passageway 23A of the housing 20. In the contact press fitting device, a press fitting locational precision of the contact 40A in the mating direction X can be ensured by automatically controlling a push-in stroke of the contact 40A to the contact receiving passageway 23A. The same applies to the contacts 40 other than the contact 40A.

After press fitting of all the contacts 40 is completed, the contact 40 having the L shape provided with the bent section 45 is formed by bending the vertical section 44 at a predetermined location. Thereafter, the tine plate 30 is mounted in the housing 20 so as to allow distal ends of the contacts 40 provided with the tines 46 to extend there through, and the electrical connector 10 is thus obtained.

An advantageous effect provided by the electrical connector 10 in the shown embodiment will be described below.

Figure 7:
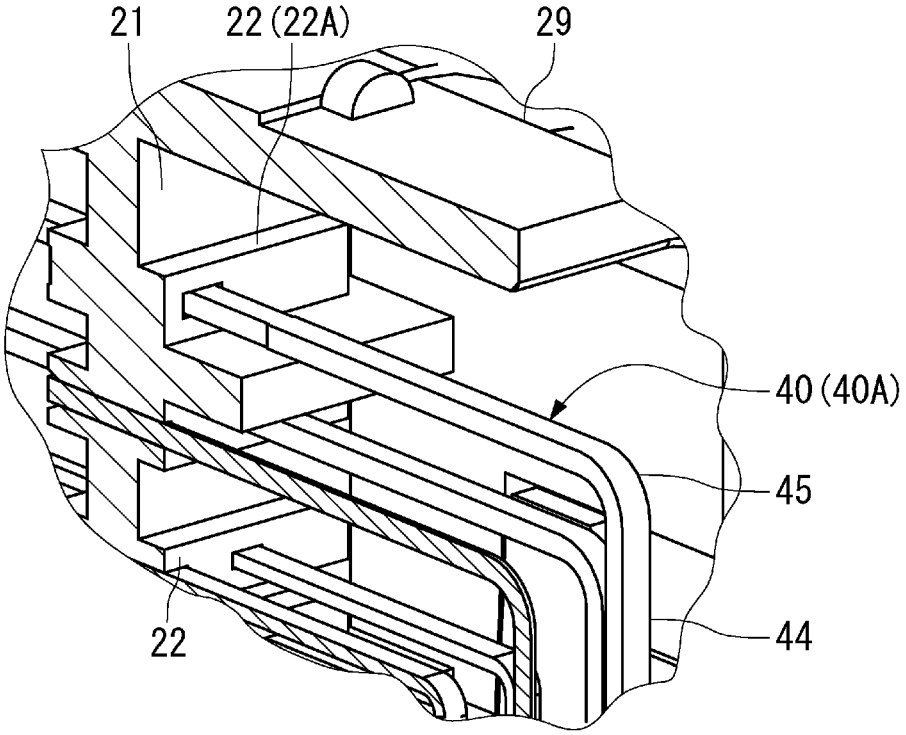

In the electrical connector 10, as shown in FIG. 2B, regarding the contact 40A positioned at the uppermost level, a rearward protrusion amount of the press fitting support 22A is increased so that the held length is gained. Therefore, as shown in FIG. 7, the exposed length of the contact 40A can be made short, as compared with the case where the protrusion amount of the contact 40A is substantially equal to the protrusion amount of the press fitting support 22 corresponding to the contacts 40 positioned below the contact 40A. Therefore, the natural frequency of the contact 40A is changed, and the contact 40A can be thereby prevented from being broken by resonance when the electrical connector 10 is subjected to vibration.

Next, in the electrical connector 10, since the rearward protrusion amount of the press fitting support 22A is increased, the front press fitting section 51 and the rear press fitting section 55 are provided in the contact 40A so that the contact 40A is press fit at two locations in the mating direction X. Therefore, even when the electrical connector 10 is subjected to vibration, a holding force capable of resisting this vibration can be obtained. In the case of the embodiment, since the press fitting allowance δ1 of the front press fitting section 51 is larger than the press fitting allowance δ2 of the rear press fitting section 55, the front press fitting section 51 functions to hold the contact 40A, and the rear press fitting section 55 assists in positioning.

Further, in the process of press-fitting the contact 40A into the contact receiving passageway 23A, since the contact 40A is supported on the two locations of the front press fitting section 51 and the rear press fitting section 55, even when the contact 40A is pushed in forcefully, buckling due to inclination of the contact 40A can be prevented between the front press fitting section 51 and the rear press fitting section 55.

Besides, in the shown embodiment, since the press fitting allowance δ2 in the rear press fitting section 55 is smaller than the press fitting allowance δ1 in the front press fitting section 51, a force to insert the contact 40A into the contact receiving passageway 23A for press fitting can be kept low. In addition, in the shown embodiment, since the pitch P between the front press fitting section 51 and the rear press fitting section 55 and the depth D of the second contact receiving section 25 are equalized, supporting the contact 40A at the two locations of the front press fitting section 51 and the rear press fitting section 55, can be ensured.

An embodiment of the invention has been described above on the basis of the electrical connector 10, but, unless a departure from the gist of the invention is made, constituents introduced in the above embodiment can be selectively adopted or omitted, or appropriately replaced with another constituent.

For example, the example where only the contact 40A includes two press fitting sections of the front press fitting section 51 and the rear press fitting section, but the other contacts 40 provided below the contact 40A can also be provided with two press fitting sections, if necessary. Further, the number of press fitting sections is not limited to two, therefore the present invention can also be provided with more than two press fitting sections according to the held length.

Furthermore, the front press fitting section 51 and the rear press fitting section 55 are provided with the two protrusions of the first press fitting protrusions 51A, 55A, and the second press fitting protrusions 51B, 55B, respectively, but the present invention is not limited to this, and includes a form in which the front press fitting section 51 and the rear press fitting section 55 are each provided with one protrusion or more than two protrusions.

In addition, in the electrical connector 10, the pitch P between the front press fitting section 51 and the rear press fitting section 55 is made equal to the depth D of the second contact receiving section 25 so that the timing when the front press fitting section 51 is press fit into the first contact receiving section 24 and the timing when the rear press fitting section 55 is press fit into the second contact receiving section 25 are made to coincide with each other. This, as described above, is for ensuring supporting with the two locations of the front press fitting section 51 and the rear press fitting section 55.

Though equalizing the pitch P and the depth D with each other (P=D) is described to achieve the aforementioned effect, the aforementioned effect can also be obtained even when the pitch P is smaller than the depth D (P<D). That is, as long as P<D is satisfied, the rear press fitting section 55 is press fit into the second contact receiving section 25 before the front press fitting section 51 is press fit into the first contact receiving section 24, thereafter the front press fitting section 51 is press fit into the first contact receiving section 24, so that when the front press fitting section 51 is press fit in the first contact receiving section 24 alone can be avoided. In this case, though a single-location supporting state in which only the rear press fitting section 55 is press fit in the second contact receiving section 25 is created, an axial force does not act on a joining section between the front press fitting section 51 and the rear press fitting section 55 until the front press fitting section 51 is press fit into the first contact receiving section 24. In addition, since the press fitting allowance δ2 of the rear press fitting section 55 is smaller than the press fitting allowance δ1 of the front press fitting section 51, an axial force acting on a load application side of the contact 40 is smaller than an axial force acting on the rear press-fit section 55 of the contact 40, so that buckling can be prevented from occurring in such a section.

As described above, in the present invention, only the condition that the pitch P is equal to or smaller than the depth D (P<D) is used in order to avoid the situation that only the front press fitting section 51 having the large press fitting allowance δ1 is press fit into the first contact receiving section 24.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electrical connector comprising:

a housing having a retention wall, a press fitting support extending from the retention wall, and a contact receiving passageway extending through the retention wall and the press fitting support and including a first contact receiving section and a second contact receiving section extending from the first contact receiving section; and a contact secured in the contact receiving passageway and having a front press fitting section press fit with the first contact receiving section and a rear press fitting section positioned rearward of the front press fitting section at a pitch and press fit with the second contact receiving section, a width of the first contact receiving section is smaller than a width of the second contact receiving section prior to insertion of the contact in the contact receiving passageway and the pitch between the front press fitting section and the rear press fitting section is equal to or smaller than a depth of the second contact receiving section.

2. The electrical connector according to claim 1, wherein the rear press fitting section has a smaller press fitting allowance with respect to the housing than the front press fitting section.

3. The electrical connector according to claim 1, wherein the front press fitting section includes a first pair of front protrusions and a second pair of front protrusions positioned rearward of the first pair of front protrusions.

4. The electrical connector according to claim 3, wherein the rear press fitting section includes a first pair of rear protrusions and a second pair of rear protrusions positioned rearward of the first pair of rear protrusions.

5. The electrical connector according to claim 4, wherein a width of the second pair of front protrusions is larger than a width of the first pair of front protrusions.

6. The electrical connector according to claim 5, wherein the width of the first contact receiving section is less than the width of the first pair of front protrusions.

7. The electrical connector according to claim 6, wherein the width of the first contact receiving section is less than the width of the second pair of front protrusions.

8. The electrical connector according to claim 7, wherein a width of the second pair of rear protrusions is larger than a width of the first pair of rear protrusions.

9. The electrical connector according to claim 8, wherein the width of the second contact receiving section is less than the width of the first pair of rear protrusions.

10. The electrical connector according to claim 9, wherein the width of the second contact receiving section is less than the width of the second pair of rear protrusions.

11. The electrical connector according to claim 10, wherein the width of the first contact receiving section is constant along an entire length of the first contact receiving section.

12. The electrical connector according to claim 11, wherein the width of the second contact receiving section is constant along an entire length of the second contact receiving section.

13. The electrical connector according to claim 1, wherein the press fitting support includes a ridge extending along a width of the retention wall.

14. The electrical connector according to claim 1, wherein the contact is entirely enclosed and supported by the press fitting support along a length of the press fitting support.

15. An electrical connector comprising:

a housing having a retention wall, a press fitting support extending from the retention wall, and a contact receiving passageway extending through the retention wall and the press fitting support and including a first contact receiving section and a second contact receiving section extending from the first contact receiving section; and a contact secured in the contact receiving passageway and having a front press fitting section press fit with the first contact receiving section and a rear press fitting section positioned rearward of the front press fitting section at a pitch and press fit with the second contact receiving section, a width of the first contact receiving section is smaller than a width of the second contact receiving section prior to insertion of the contact in the contact receiving passageway and a first press fitting allowance of the rear press fitting section with respect to the second contact receiving section is smaller than a second press fitting allowance of the front press fitting section with respect to the first contact receiving section.

* * * * *